US006478202B1

(12) United States Patent
Glock

(10) Patent No.: US 6,478,202 B1
(45) Date of Patent: Nov. 12, 2002

(54) HOLSTER

(76) Inventor: Gaston Glock, Hausfeldstrasse 17, A-2232 Deutsch-Wagram (AT)

( * ) Notice: Subject to any disclaimer, the term of this patent is extended or adjusted under 35 U.S.C. 154(b) by 0 days.

(21) Appl. No.: 09/668,048

(22) Filed: Sep. 21, 2000

(30) Foreign Application Priority Data

Sep. 21, 1999 (AT) ..... 1612/99

(51) Int. Cl.[7] ..... F41C 33/02

(52) U.S. Cl. ..... 224/198; 224/671; 224/677; 224/678; 224/912

(58) Field of Search ..... 224/198, 671, 224/677, 678, 679, 912

(56) References Cited

U.S. PATENT DOCUMENTS 3,894,667 A * 7/1975 Baldocchi ..... 224/198
3,915,361 A * 10/1975 Perkins ..... 224/198
5,014,892 A * 5/1991 Copeland ..... 224/271
5,265,781 A * 11/1993 Nichols ..... 224/198
5,641,102 A * 6/1997 Hellweg ..... 224/198
6,161,741 A * 12/2000 French ..... 224/198

* cited by examiner

*Primary Examiner*—Stephen P. Garbe
(74) *Attorney, Agent, or Firm*—Kilpatrick Stockton LLP

(57) ABSTRACT

The invention concerns a holster with a belt part (1) and a weapon part (10), which are releasably connected to each other and are rotatable/fastenable by an undercut guide (3) of the belt part and a pushbutton (15) with fastening plate of the weapon part (10), in which the belt part is situated on the user side of the weapon part and the weapon part is situated on the weapon side of the belt part and in which the guide (3) has a guide plane on the weapon side and a guide plane facing away from the weapon.

The invention is characterized by the fact that at least one additional undercut guide (3') is provided above the first one on belt part (1) whose guide plane on the weapon side lies on the guide plane of the first guide (3) facing away from the weapon on the user side.

2 Claims, 2 Drawing Sheets

HOLSTER

The invention concerns a holster consisting of a belt part and a weapon part, which are releasably joined to each other and are rotatable/fastenable by an undercut guide on the belt part and a pushbutton with attachment plate of the weapon part. This type of holster is known from AT 388 448 B. The disclosure contents of this document are referred to in the present application. The holster known from the AT-B has proven itself and has become quite common especially among persons who must wear firearms professionally, like policemen, gendarmes, highway patrolmen, dispatch riders in the military, etc.

Depending on the area of application, different forms of this holster have been used, in which it turned out over time that there is a great demand for holsters of different length, i.e., holsters with different spacing between the belt on which the holster is mounted and the connection point between the belt part and the weapon part of the holster. The reasons for this lie primarily in the fact that the uniform (service clothing) of the persons mentioned in the introduction deviates between winter and summer clothing and that the weapon is used with a short or long uniform coat depending on this. Because of this double variant, stocking and increased investment costs, as well as the replacement of parts and storage of the corresponding unneeded part, are shortcomings, since this is logistically costly and also burdensome, especially in the transition period when, depending on the order of the day, one uniform is prescribed and then the other.

A demand therefore exists for a holster in which the mentioned spacing can be varied between at least two lengths, in which the holster must naturally exhibit the same wearing comfort as the already known holster and the same safety for the user.

The mentioned problems are avoided or solved according to the invention if at least a second undercut guide is provided in a holster of the type mentioned at the outset, in which in a particularly preferred variant, the guide plane on the weapon side is the one undercut guide and the guide plane facing away from the weapon is the other undercut guide.

In this manner it is possible to produce the belt part of the holster as before in one piece by injection molding of plastic and above all, it is possible to devise such a tandem holster without having to make it noticeably stronger, i.e., without positioning the weapon farther away from the wearer. The term "guide plane" is not to be viewed mathematically here, but can be assumed by the two surfaces of the thin component, for example the base plate of the belt part.

Such an increase in spacing is normally unavoidable in view of the use of an undercut to connect the two holster parts, since the protruding guide part of one of the two guides, usually the upper one, stands in the way of the other lower guide. This is prevented by the expedient according to the invention.

DETAILED DESCRIPTION OF PREFERRED EMBODIMENT

Figure 1A:
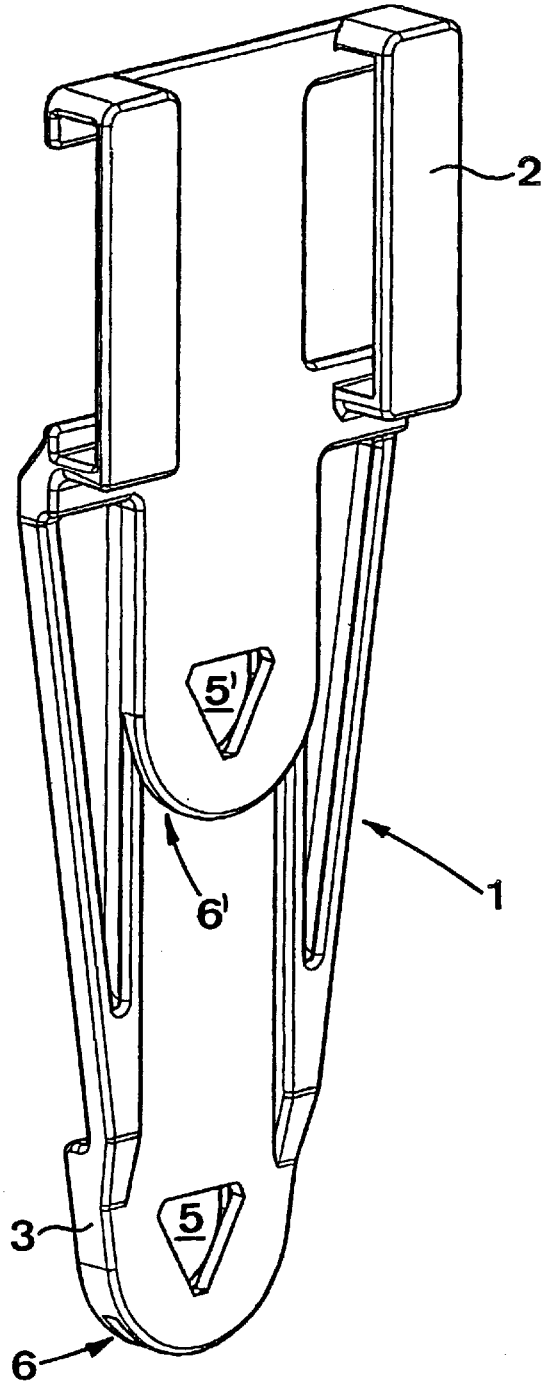
FIGS. 1A and 1B show a belt part according to the invention, in two perspective views.
Figure 1B:
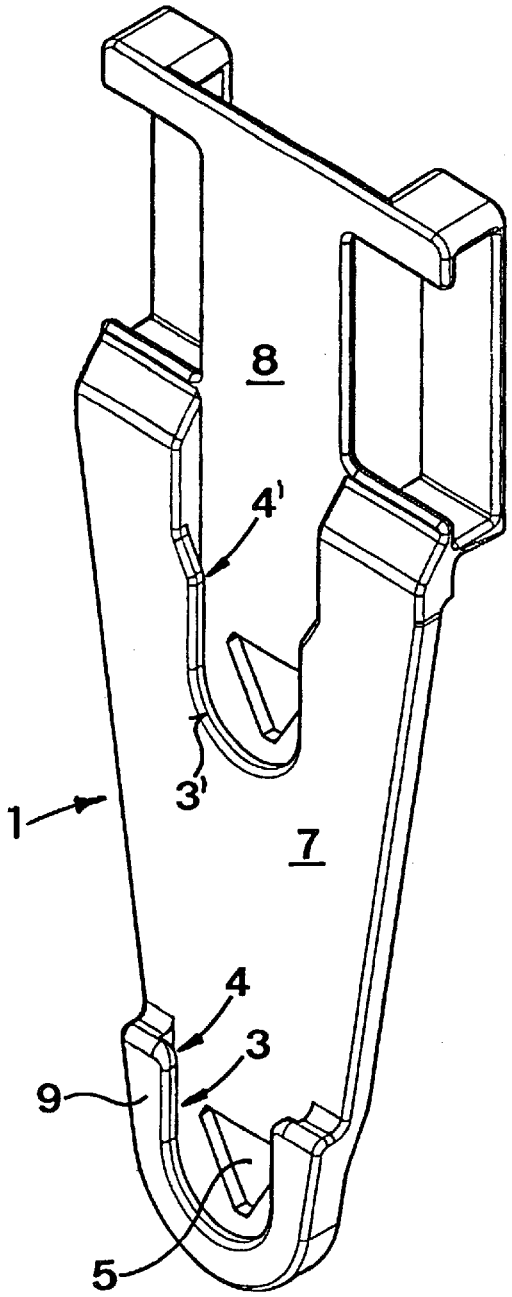

The design is clearly apparent from the perspective view of a belt part 1 depicted in FIG. 1: In the upper region, loops 2 for threading a belt are provided. A U-shaped guide 3 having an undercut 4 is situated on the lower end. In the region around the center point of the circular arc of guide 3, an opening 5 is situated in a base plate 7, which has the shape of an equilateral triangle with truncated corners. The base plate 7 in guide 3 serves as the guide plane on the weapon side for a pushbutton 15 of weapon part 10.

This form has gained acceptance in practice relative to the circular form of opening 5 depicted in the AT-B and also replaces the fastening mechanism depicted there. For this purpose, the pushbutton 15 on weapon part 10 of the holster (FIG. 2) is simultaneously designed as a round guide disk and a triangular fastening plate lying beneath, connected in one piece to pushbutton 15, which, when it is congruent to opening 5, protrudes farther under the force of a spring and thus blocks the rotational mobility between belt part 1 and weapon part 10.

By partial pressing of pushbutton 15, the triangular fastening plate now leaves the region of opening 5, but the circular part of the pushbutton 15 remains in this region and thus rotatability between the two parts is again provided without them being separable. Only with further still deeper pushing of pushbutton 5 does the outside of this pushbutton also leave the region of opening 5 and the weapon part 10 can then pushed upward, viewed in FIG. 2, from the undercut guide 3.

A U-shaped recess is now provided according to the invention in such a holster in base plate 7 and a support plate 8 is provided parallel to the base plate 7 at a spacing from it on the side away from the weapon, which together with the U-shaped recess of the base plate forms an undercut guide 3' designed similar to guide 3. The front guide part 9 of guide 3 is situated at essentially the same spacing in front of base plate 7 as the support plate 8 is behind base plate 10 and the base plate 7 in this guide serves as the guide plane facing away from the weapon.

By this expedient, on the one hand, the additional guide 3' does not interfere with use of guide 3 and, on the other hand, the extent of belt part 1 is only minimally increased normal to base plate 7 (its thickness).

The support plate 8 now has an opening 5' whose arrangement and effect are completely analogous to the opening 5 of guide 3 and base plate 7.

Figure 2A:
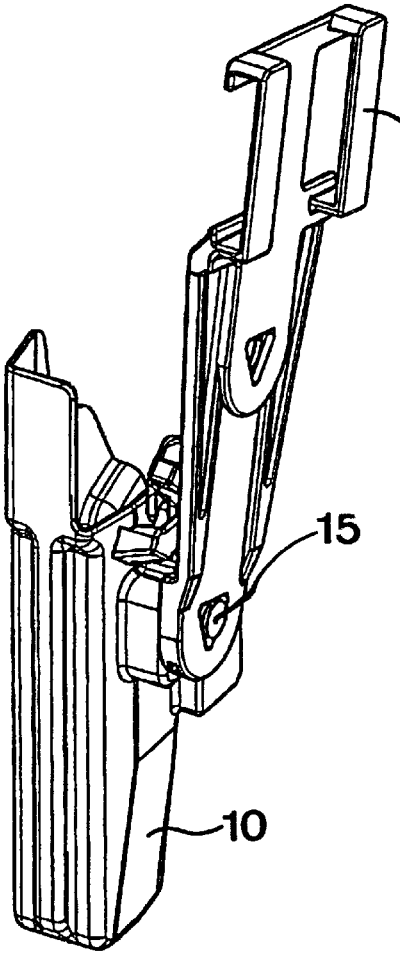
FIGS. 2A and 2B show a holster according to the invention, also in two perspective views.
Figure 2B:
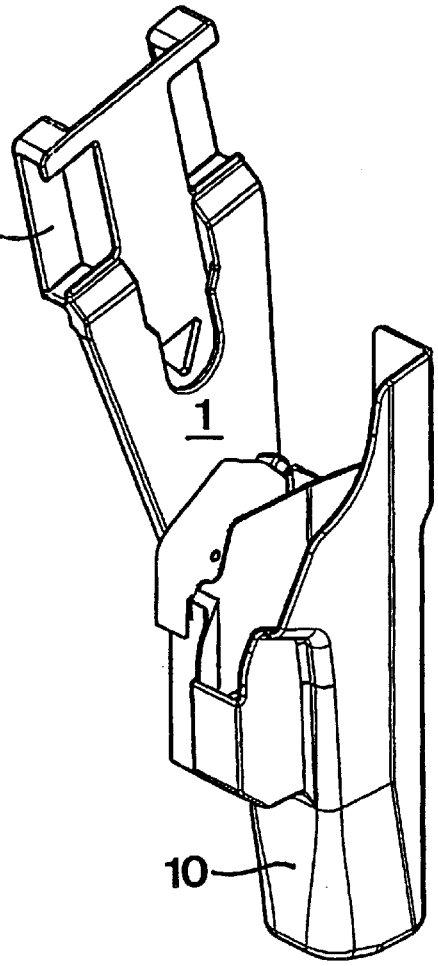

Cooperation with a weapon part 10 is apparent in FIG. 2, in which the function of the undercut guide and its cooperation with pushbutton 5 are also apparent.

The extent of belt part 1 and thus the entire holster normal to base plate 7 (thickness of the holster) can be further reduced if the base plate 7 is not designed completely flat, but, as is anatomically favorable in most cases, has a curvature so that the guide 3 at least partially goes beneath guide 3' when the tangential plane is brought to the base plate in the region of guide 3 as vertical plane. The guides 3, 3' then no longer run in planes parallel to each other.

Reinforcement strips are apparent from FIG. 1 and the left part of FIG. 2, which stiffen the base plate 7 and connect it to support plate 8 so that the necessary mechanical stability of the belt part can be achieved without large wall thicknesses. In the depicted practical example, the belt loops 2 are offset rearward from the support plate, but it is not necessary to do this to the degree depicted.

The support plate 8 can lie in the region of loop 2 (upper part of the holster) closer to the plane of the base plate so that the thickness of the belt part and the spacing of the base plate from the belt can be further reduced.

The weapon part 10 of the holster, which is shown in FIG. 2, has different safeties, which are supposed to prevent the weapon (not shown) from being removed from the holster against the will of the user, for example, in the course of a scuffle. Naturally it is not necessary that the weapon part of the holster be designed this way and other weapon parts 10 can also be used if they have the corresponding guide elements.

The essential advantage of the invention is that the previously long and short variants of the belt parts can be replaced by the belt part according to the invention without having to provide new weapon parts 10.

Like the holster according to the AT-B, this holster also preferably consists of plastic, but this is already known in the prior art and is not a central part of the invention.

What is claimed is:

1. Holster with a belt pat (1) and a weapon part (10), which are releasably connected to each other and are rotatable and fastenable via an undercut guide (3) of the belt part and operatively associated with a pushbutton (15) with a fastening plate of the weapon part (10), in which the belt part is situated on a user side of the weapon part and the weapon part on a weapon side of the belt part, and in which the guide (3) has a guide plane on the weapon side and a guide plane facing away from the weapon, characterized by the fact that at least an additional undercut guide (3') is provided above the first undercut guide on the belt part (1), and that the additional undercut guide has a guide plane on the weapon side that lies spaced apart from a surface of the first guide (3) facing away from the weapon on the user side, so that the additional guide (3') does not interfere with use of the guide (3).

2. A holster according to claim 1, wherein the guides (3, 3') are arranged on a base plate (7) whose surface facing the weapon forms the guide plane of the first guide (3) on the weapon side and whose surface facing away from the weapon forms the guide plane of the second guide (3') facing away from the weapon side.

* * * * *